United States Patent [19]

Chesworth

[11] Patent Number: 4,656,753

[45] Date of Patent: Apr. 14, 1987

[54] POST SUPPORT UNIT FOR A BUILDING PROFILE

[76] Inventor: Noel D. Chesworth, 609 Plum Grove Rd., Roselle, Ill. 60172

[21] Appl. No.: 790,189

[22] Filed: Oct. 22, 1985

[30] Foreign Application Priority Data

Nov. 28, 1984 [GB] United Kingdom ..... 8429975

[51] Int. Cl.[4] ..... B43L 13/00

[52] U.S. Cl. ..... 33/408; 33/410

[58] Field of Search ..... 33/404, 405, 406, 407, 33/408, 410, 413

[56] References Cited

U.S. PATENT DOCUMENTS

| | | | |
|---|---|---|---|
| 2,623,289 | 12/1952 | Kampel | 33/410 |
| 3,039,196 | 6/1962 | Jernigan | 33/410 |
| 3,096,588 | 7/1963 | Cook | 33/410 |
| 3,104,468 | 9/1963 | Sarles | 33/410 |
| 3,114,975 | 12/1963 | Jones | 33/406 |
| 3,127,683 | 4/1964 | Garton et al. | 33/406 |
| 3,127,684 | 4/1964 | Ernst | 33/408 |
| 3,153,285 | 10/1964 | Senko | 33/410 |

*Primary Examiner*—Richard R. Stearns
*Attorney, Agent, or Firm*—Fitch, Even, Tabin & Flannery

[57] ABSTRACT

A post support unit for use in establishing a straight line along which a wall of bricks or blocks may be built is provided with a pair of upper and lower plate units which have edges which are inserted into unmortared joints in a corner for the wall. The upper plate unit is supported on three legs and after the upper plate unit has been leveled into a horizontal plane, fasteners are tightened on the legs to clamp the upper and lower plate units to the bricks. A post has its lower end inserted into a socket on a lower plate unit. The post is then trued to the vertical and adjustment screws are tightened to lock the post at the true vertical. In other instances the post may be aligned at a predetermined angle to the vertical where the corner of the wall is to extend inwardly or outwardly relative to the true vertical. The post is locked in its predetermined orientation by adjustment screws.

6 Claims, 9 Drawing Figures

POST SUPPORT UNIT FOR A BUILDING PROFILE

BACKGROUND OF THE INVENTION

The present invention relates to a post support unit for a building profile for use in establishing a straight line along which a wall may be built.

In the construction of walls for buildings, it is conventional practice for the bricklayer to build up two leads or corners between which a string, or the like, is run to establish the line of the wall. The brick layer can then build the wall along the line of the string and up to the level thereof. It is then necessary for the bricklayer to build up the levels of the leads or corners so that the level of the string may be raised to allow building of the wall to continue. This process must be repeated several times during the building of the wall and is a time-consuming exercise.

It is an object of the present invention to provide a post support unit for use in constructing a building profile for establishing a straight line along which a wall may be built, the profile being such that the need repeatedly to build up a lead or a corner is avoided.

According to the present invention there is provided a post support unit for a building profile comprising upper and lower post support elements each adapted to locate partly in a joint between brick or block-work, and the upper support element having an aperture through which a post may be passed and the lower support unit being adapted to support the lower end of the post, and means for holding the upper and lower support elements in a fixed spaced apart relationship.

Preferably the upper and lower support elements are each associated with means for securing a post supported by the unit in a perpendicular position.

The post support unit of the invention may be mounted on brick or block work and used to support a post in a vertical position. Two such assemblies of support unit and associated posts may be mounted on brick or block-work which have been constructed at two spaced locations and between which a wall is to be built. A builders line may then be run between the two posts and the brick or block-work laid along the line. The builders line may simply be moved up the posts as the wall grows in height, thereby avoiding the need repeatedly to build up leads or corners for defining the line of the wall.

It will be appreciated that the post-support unit of the invention may be supplied as a kit of parts and that the present application also protects such kits of parts.

The invention will be further described by way of example only with reference to the accompanying drawings, in which.

Figure 2:
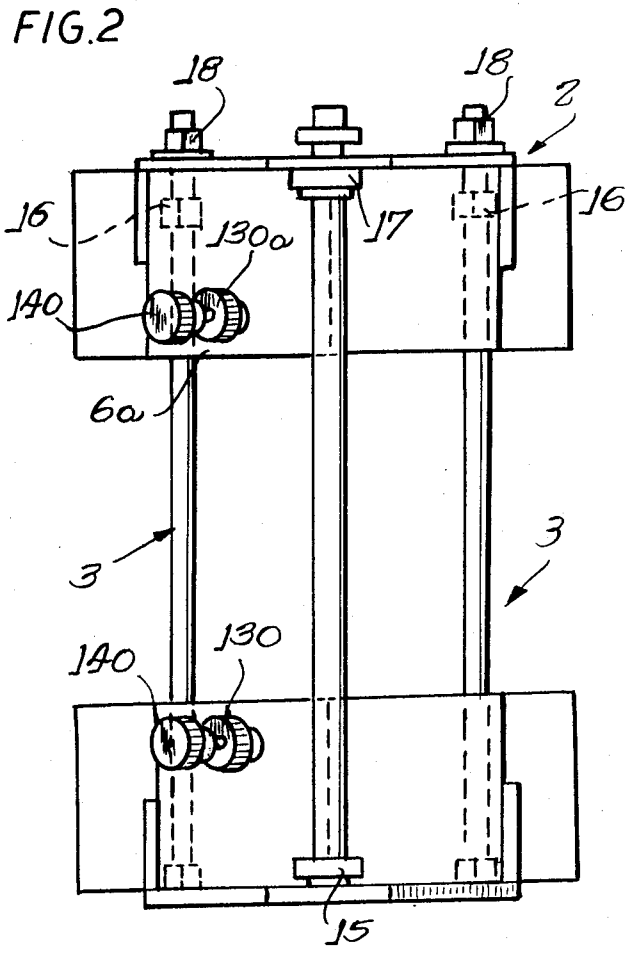
FIG. 2 is a view looking in the direction of arrow A of the post support unit shown in FIG. 1 but omitting the post.
Figure 1:
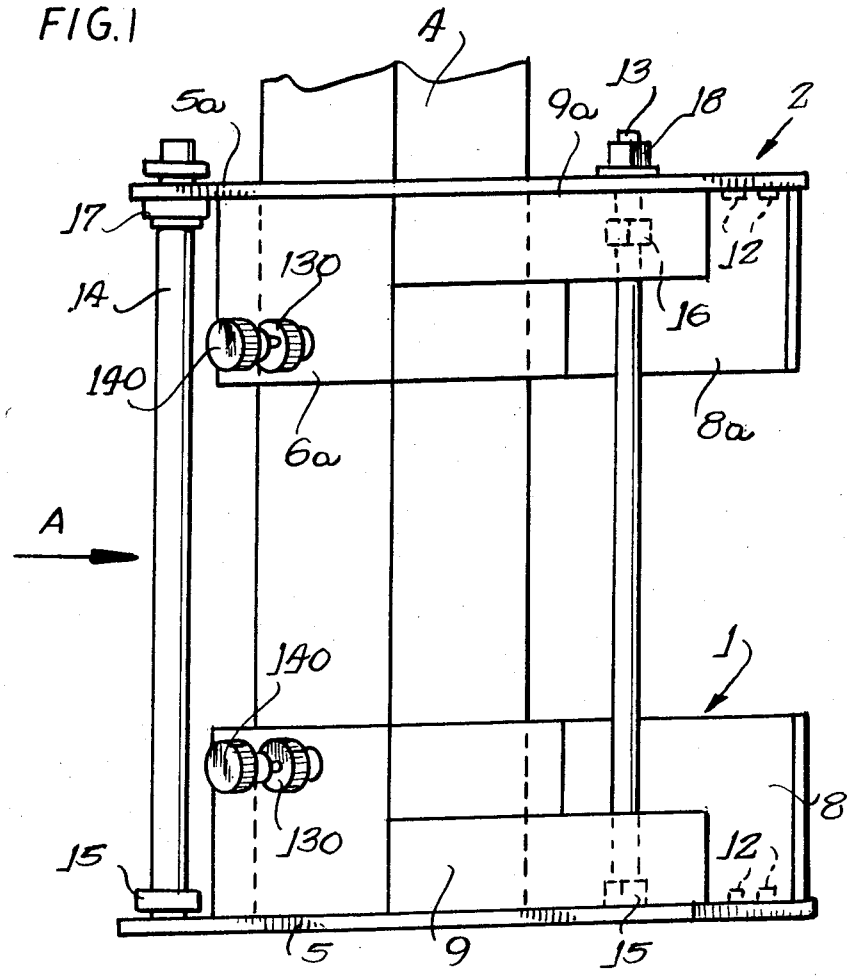
FIG. 1 shows a side view of one embodiment of post support unit in accordance with the invention for location externally of a corner of a building and shown supporting a post.

FIG. 1 shows an assemblied building profile which comprises a post support unit and a post 4 supported therein. The post support unit comprises a lower support element 1 (hereinafter referred to as the lower plate unit 1), and an upper support element 2 (hereinafter referred to as the upper plate unit 2) supported above plate unit 1 by three rod assemblies 3.

The post 4 extends vertically for a distance such as about seven feet from the lower plate unit 1; and after the unit is attached to the corner wall (FIG. 3), the post is plumbed to be vertical and locked in position. A string or line is run between posts 4 at opposite corners of the wall. Usually, the string is moved up the post a distance equal to the height of one brick, plus a mortor joint, or one building block, plus a mortor joint, described as a course of bricks or blocks. As will be explained, the lower plate unit attaches to the bricks or blocks at the wall corner and projects outwardly therefrom and serves as support for the post 4 which will be plumbed vertical and then locked in the vertical position on the post support unit.

Figure 3:
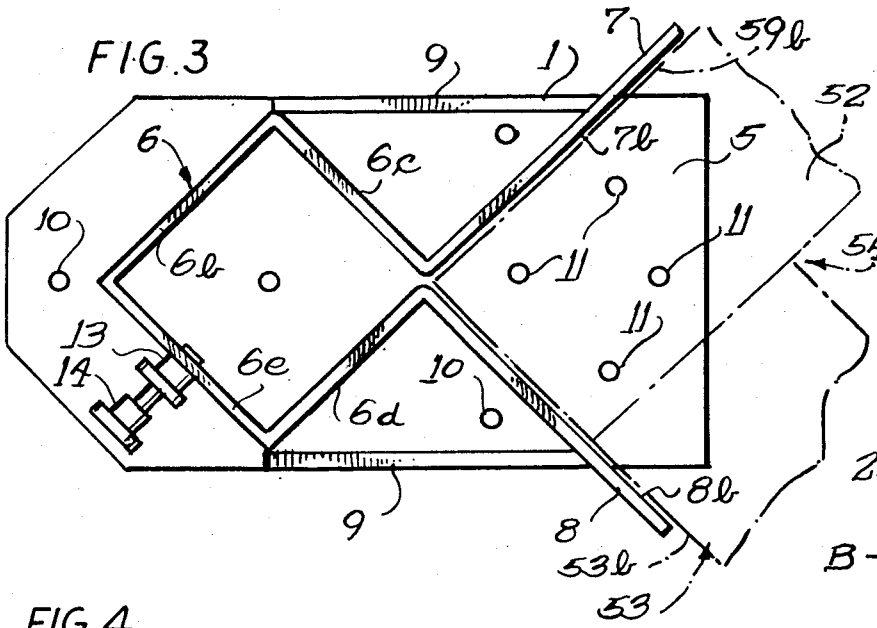
FIG. 3 shows a plan view of a lower support element for use in the support unit shown in FIG. 1.
Figure 4:
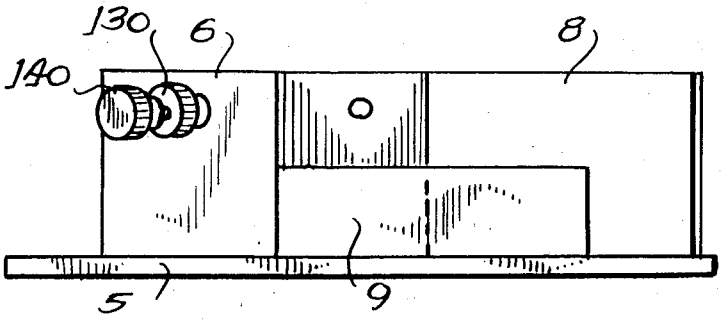
FIG. 4 is a side view of the support element shown in FIG. 3.

Lower plate unit 1 is shown in more detail in FIGS. 3 and 4 and comprises a generally rectangular, steel bottom plate 5 tapering in width towards one end thereof, as best seen in FIG. 3, on one face of steel plate 5 is a square-section, steel post socket 6 formed of four upstanding socket walls **6*b*, 6*c*, 6*d* and 6*e*. These walls define an open socket having an open top end into which will be inserted the lower end of the post 4. Aligned with the socket walls 6*c* and 6*d* are a pair of wings 7 and 8 forming an angle of 90° to each other, with each wing 7 or 8 being at 45° to the centre line of plate 5. The wings 7 and 8 are plates having lower edges abutting the top of the bottom plate 5. Inner sides 7*b* and 8*b* of the wings abut sides 50 and 51 respectively of bricks 52 and 53 which define a corner 54 for the building walls. Reinforcement plate elements 9 are provided along the edge of plate 5 between each wing 7 or 8 and the post socket 6**.

Three threaded apertures 10 (FIG. 3) are provided in plate 5 for receiving therein the lower end of a rod assembly 3 in the manner to be described. One such aperture 10 is drilled on the centre-line of plate 5 towards the end thereof remote from wings 7 and 8, and the other two apertures 10 are each formed in the plate 5 within the triangle defined between a wing 7 (or 8), a reinforcement element 9 and a side of socket 6.

Further apertures 11 (FIG. 3) are provided in plate 5 between wings 7 and 8 for accommodating studs 12, or the like, which project a short distance above plate 5 on the same side thereof as post socket 6. These studs will abut the bricks 52 and 53, as will be described hereinafter.

Each side of post-socket 6 is provided with an adjustment screw 130 associated with a knurled locking nut 140 (only one such assembly of screw 130 and nut 140 being shown in the drawings) the function of which will be described later.

Upper plate unit 2 is generally simmilar to lower plate unit 1 and similar parts are referenced by the same numeral suffixed with the letter "a". There are however two differences between the upper and lower plate units, save in two respects. Firstly, in upper plate unit 2, the plate 5*a* does not extend beneath post socket 6*a* but has an opening allowing a post 4 to be inserted through opening and to project above the upper unit 2. Secondly, the apertures lO*a* formed in the plate 5*a* are of slightly larger diameter than apertures 10 of lower plate unit 1.

Rod assemblies 3 spaced the upper plate unit from the lower plate unit and are each comprised of terminally screw-threaded central rods 13 which extend within and which are covered by cylindrical, hollow covering tubes 14 which protect the rods 13 from mortar splashes, etc. during use of the profile.

The asembly and use of the profile illustrated with reference to FIGS. 1 to 4 will now be described.

Firstly, the lower ends of the rods 13 are screwed into apertures 10 in bottom plate 5 of lower plate unit 1 until the end of the rod is flush with the underside of the plate 5. A lock-washer and nut 15 is then positioned on the top-side of plate 5 using a locking agent such as a lock-tite stud fastener; the rods 13 are secured fastened to the bottom plate and extend upwardly therefrom.

Tubes 14 are then telescoped over each of rods 13. The two rods 13 adjacent the wings 7 and 8 are provided with an upper nut 16 and the other rod 13 is given a knurled nut 17.

Upper plate unit 2 is now positioned on rods 13 with its post-socket 6*a* pointing towards lower plate unit 1. Then, washers and nuts 18 are threaded on the protruding upper ends of rods 13 and against the upper side of the plate 5*a* to lock it to the rod assemblies. Unit 2 is prevented from falling towards lower plate unit 1 by virtue of the nuts 16 and 17 on rods 13.

The assembly thus produced, which hereinafter will be referred to as the base unit, is designed, by appropriate selection of the lengths of rods 13 to bridge three courses of standard bricks or one course of blocks at a corner of a wall under construction. To fix the base unit in position externally of a corner, two horizontal mortar joints in the wall at a spacing equal to three courses of regular brick, or one course of building block (about 8 inches), corresponding to the distance between plates 5 and 5*a* are left free of mortar, the adjustment nuts 18 are loosened to allow movement of upper plate unit 2 relative to lower plate unit 1 (any such adjustment being effected by knurled nut 17) and the untapered ends of plates 5, 5*a* are inserted into the unmortared joints in the wall such that the wings sides 7*b* and 8*c* engage against the sides 52*b* and 53*c* of the bricks 52 and 53 at the corner of the wall.

Hand pressure is now applied to ensure that plates 5 and 5*a* are horizontal and the level or other device may be used to assure that the plates are truly horizontal. The post sockets 6 and 6*a* are aligned.

Nuts 18 are tightened as necessary to clamp upper plate unit 2 in a true horizontal position relative to lower plate unit 1. This clamping action, ensures that studs 12 and 12*a* on the plates 5 and 5*a* engage firmly against horizontal surfaces on the brickwork at point locations only thus concentrating the holding power of the clamping action at these points of contact of the studs 12, 12*a* with the brickwork.

The four adjustment screws 130 in post-socket 6 and the corresponding screws 130*a* in socket 6*a* are now withdrawn to their fullest extent to give sufficient clearance for insertion of post 4. The post 4 may now be lowered through post socket 6*a* until its lower end locates in the bottom socket 6 with its end face lying on that portion of plate 5 bounded by socket 6.

Post 4 is now held in contact with the two adjustment screws 130*a* in the upper plate unit 2 which are closest to the corner of the wall. A level or other plumbing device laid against a vertical side of the post 4 to make sure that the post is truly vertical when the builders line is attached thereto and run to an opposite corner of the wall. After plumbing the post 4 and while holding it vertical, the four lower adjustment screws 130 and the remaining two upper adjustment screws 130*a* are now turned so that post 4 is held in a truly perpendicular position with all eight adjustment screws 130 and 130*a* making good contact with the post 4. Locking nuts 140 are now turned so as to make firm contact with the post socket 6 or 6*a*.

Two profile units assembled as described above are provided one at each of two corners between which a wall joining the corners is to be built. The ends of a guide string may now be attached to the post of each profile unit and marks the line of the wall to be built. The bricklayer may now lay bricks along the line of the wall up to the height of the guide string, at which point the string needs only to be moved further up the guide posts 4 before the bricklayer can continue. Consequently, there is no need for the brick layer repeatedly to build up the corner section of the wall before the guide string can be raised in height, as was the prior practice.

Figure 5:
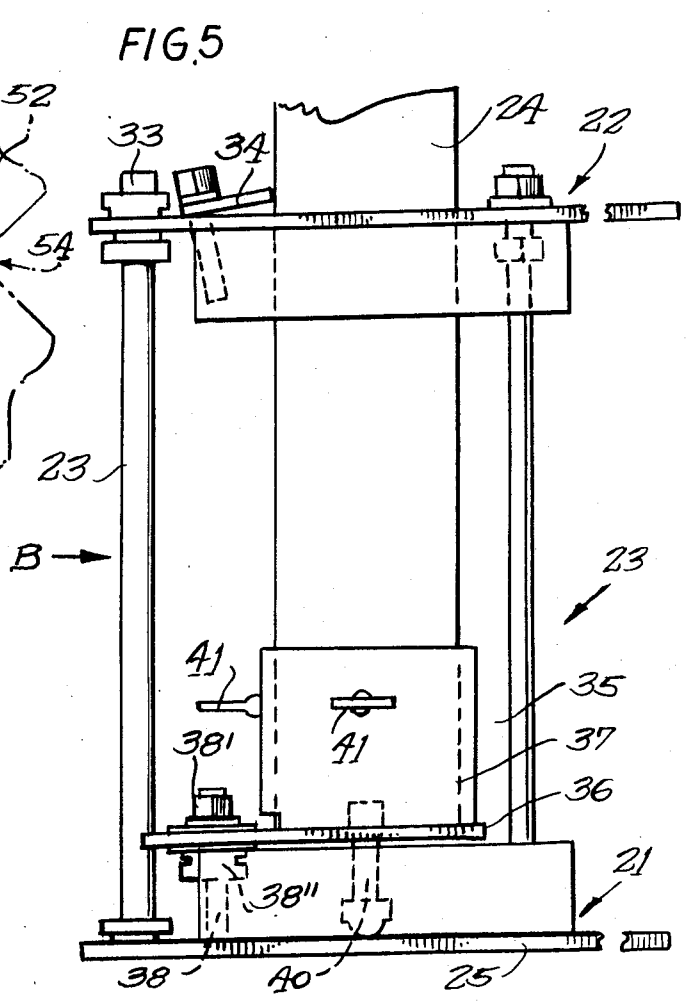
FIG. 5 is a side view of a second embodiment of post support unit in accordance with the invention for location internally of a corner of a building and shown supporting a post.

The profile shown in FIG. 5 is generally similar to that shown in FIG. 1 in that it comprises a lower plate unit 21, an upper plate unit 22 supported above plate unit 21 by three rod assemblies 23, and a post 24.

Figure 7:
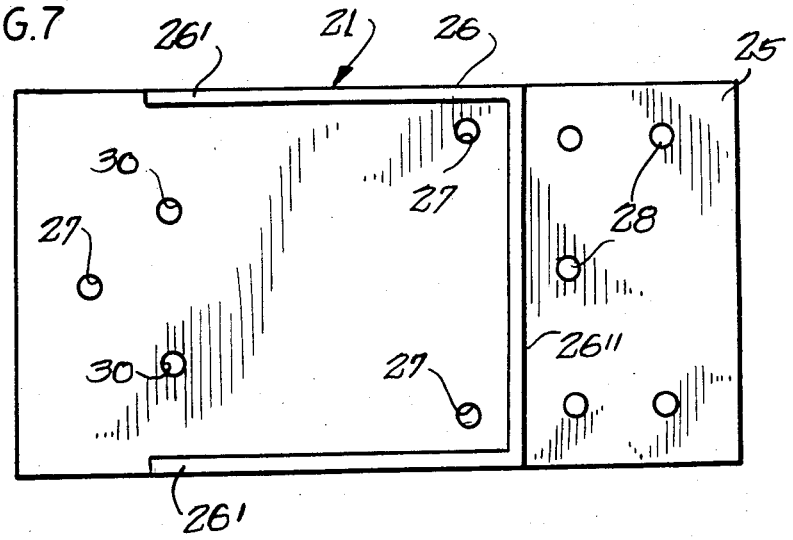
FIG. 7 is a plan view of a lower support element unit for use in the unit shown in FIG 5.

Lower plate unit 21 is shown in FIG. 7 and comprises a rectangular plate 25 with an upstanding bracket 26 which is U-shaped in plan with two limbs 26' an upstanding bracket 26 which is U-shaped in plan with two limbs 26' extending along opposed edges of plate 25 and connected by a bridging piece 26''. Plate 25 has three apertures 27 for location of rod assemblies 23 (as previously) and five apertures 28 for accommodating studs 29 (again as previously).

Two further apertures 30 are also provided in plate 25.

Figure 8:
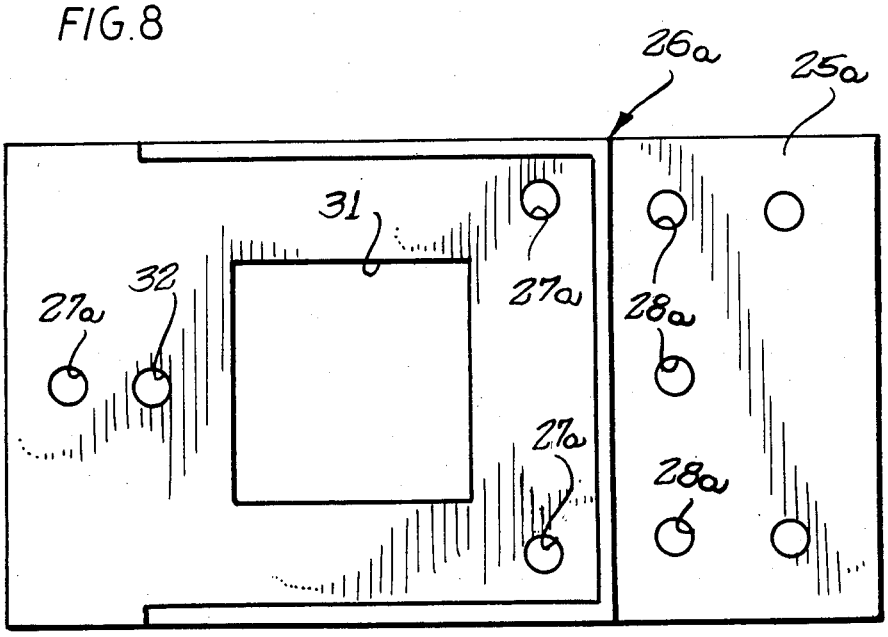
FIG. 8 is a plan view of an upper support element use in the unit shown in FIG. 5.

Upper plate unit 22 is shown in FIG. 8 and is generally similar to lower plate unit 21 and like parts are designated by the same reference numerals suffixed with the letter "a". There are however four differences between plate unit 21 and 22. Firstly, plate unit 22 incorporates a square aperture 31 through which post 24 may pass. Secondly, unit 22 does not incorporate apertures 30. Thirdly, apertures 27*a* are of larger diameter than apertures 27. Fourthly, unit 22 has an additional aperture 32 angled at 10° away from the perpendicular through plate 25*a*.

Aperture 32 serves to accommodate a bolt 33 with associated pressure plate 34 (see FIG. 5).

Figure 9:
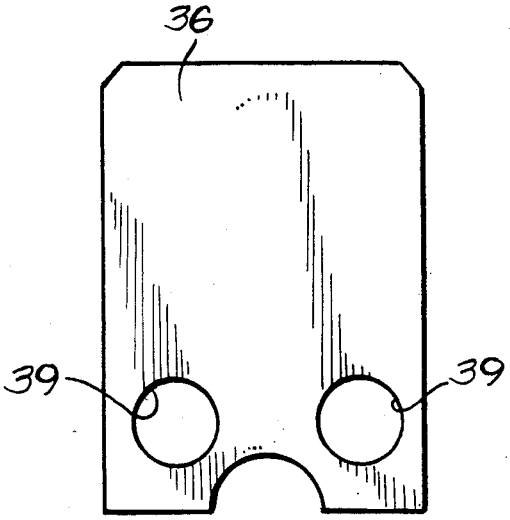
FIG. 9 is a plan view of part of the floating base of the unit shown in FIG. 5.

The asembled profile shown in FIG. 5 includes a floating base assembly 35 comprised of a plate 36 (of the form shown in FIG. 9) with a post socket 37. Floating base assembly 35 is supported on the lower base unit 21 by two bolts 38 passing through apertures 39 in plate 36 (see FIG. 9) and engaging in apertures 30 in plate 25. Bolts 38 are associated with lock nuts 38' and knurled nuts 38''. Additionally, plate 36 is associated with a dome-headed rod 40, having at its lower end a dome-headed portion abutting the top side of plate 25 for rocking motion thereon.

Provided in post socket 37 are two thumbscrews 41.

Figure 6:
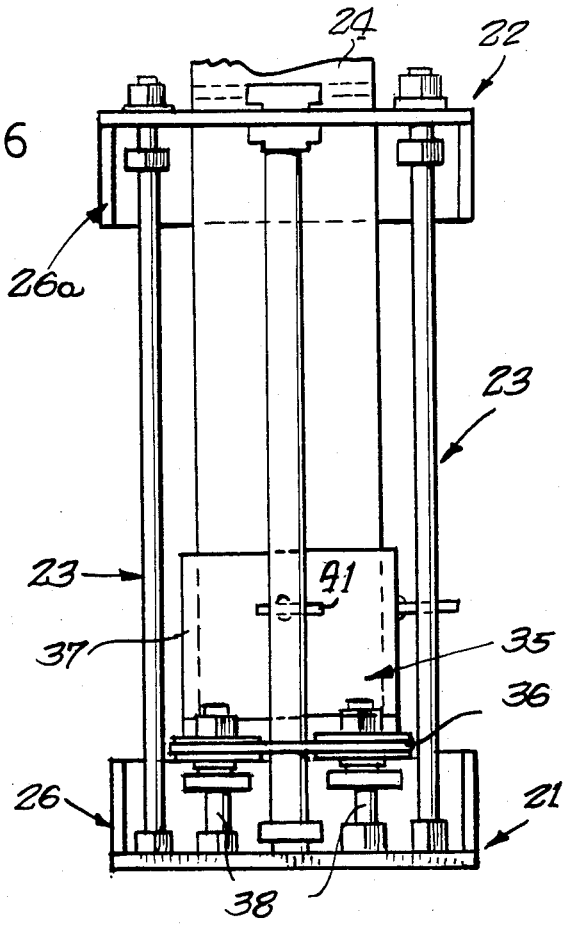
FIG. 6 is a view looking in the direction of arrow b in FIG. 5.

In use, the base unit of the profile (i.e., the assembly of upper and lower plate units 21 and 22 and the rods 23) is positioned on the interior of a corner of brickwork in much the same manner as for the assembly shown in FIG. 1 to 4. As best seen in FIG. 6, the wall 26' abuts one brick 60 and the wall 26" abuts a brick 52 at the interior corner of a wall.

Nuts 38', which lock the floating base assembly 35 in position, are now slackened and thumbscrews 41 are retracted to ensure that post 24 will locate in socket 37. The post 24 may now be inserted through aperture 31 and advanced so that it locates in socket 37. Thumbscrews 41 are now tightened to secure post 24 firmly in place.

With post 24 in near perpendicular position, bolt 33 is tightened so that pressure plate binds against post 24.

Floating base assembly 35 is now moved to shift the post 24 slightly with a level against the vertical side of the post until the post 24 is truly perpendicular. Knurled nuts 38" are adjusted with washers until contact is made with the underside of floating base.

Nuts 38' are then tightened to secure the floating base assembly 35 in place.

Finally, bolt 33 is retightened to lock the free end of the pressure plate 34 against the post 24.

It will be appreciated from the foregoing description that, at no time, does the post make contact with the wall being constructed. Consequently, it is possible to finish the surface of the wall (e.g., by pointing, etc.) in the proximity of the posts in an unrestricted manner.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A post support device for attachment to a corner building wall having mortared joints between adjacent bricks or blocks; said device comprising:

a lower support means having an edge to be inserted into one of the unmortared joints in the corner wall, an upper support means spaced above said lower support means having an edge to be inserted into another of the unmortared joints in the corner wall, vertical spacer means extending between said upper and lower support means and joining the same together, said vertical spacer means being spaced from the corner wall, one of said support means being angularly adjustable relative to said vertical spacer means, securing means for securing the angularly adjustable support means at a fixed position after it has been located in a horizontal plane at a unmortared joint, said securing means and said upper and lower support means clamping said device to said corner wall, a post removably mounted in said upper and lower support means and supported by said upper and lower support means in a location spaced from the corner wall, and releasable locking means for said post cooperating with, at least, one said upper and lower support means for locking the post at a predetermined vertical position after said post has been aligned at a predetermined vertical orientation.

2. A post support device in accordance with claim 1 in which said vertical spacer means comprise three vertically extending legs fixed at their lower ends to the lower support means and having threaded upper ends, said securing means comprising nuts for threading onto the threaded upper ends of said legs to lock said upper support means in a horizontal plane after the upper support means has been leveled.

3. A post support device in accordance with claim 1 including point contact means on the upper and lower support means to engage the bricks at the unmortared joint.

4. A post device means in accordance with claim 1 in which said releasable locking means for said post comprises separate releasable locking means on said upper and lower support means respectively for locking the post at angle to the true vertical.

5. A device in accordance with claim 1 in which said lower support means includes a socket with an open upper end to receive a lower end of the post.

6. A device in accordance with claim 5 in which wings are associated with the socket and extended at 90° to one another to engage the corner wall to locate the device on the wall.

* * * * *